US006302399B1

(12) United States Patent
Prinzing

(10) Patent No.: US 6,302,399 B1
(45) Date of Patent: Oct. 16, 2001

(54) SEALING DEVICE AND PROCESS FOR SEALING A MOVING SURFACE WITH THE SEALING DEVICE

(75) Inventor: Hans Prinzing, Heidenheim (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/262,333

(22) Filed: Mar. 4, 1999

(30) Foreign Application Priority Data

Mar. 16, 1998 (DE) ..... 198 11 355

(51) Int. Cl.[7] ..... F16J 15/46

(52) U.S. Cl. ..... 277/300; 277/580; 277/583; 162/371

(58) Field of Search ..... 277/300, 583, 277/553, 558, 580, 581, 605, 645, 646, 578, 589; 162/371, 369, 368, 370, 363

(56) References Cited

U.S. PATENT DOCUMENTS 2,274,641 * 3/1942 Abbott et al. .
2,649,719 * 8/1953 Hornbostel .
3,722,895 * 3/1973 Mevissen .
3,802,961 4/1974 Grass et al. .
4,058,435 11/1977 Williams, Jr. .
4,448,425 * 5/1984 Von Bergen .
4,714,523 * 12/1987 Sawyer, Jr. et al. ..... 162/371
5,341,726 * 8/1994 Watson ..... 92/80
5,511,795 * 4/1996 Laubach et al. .
5,580,424 12/1996 Snellman .
5,975,532 * 11/1999 Karttunen et al. ..... 277/300

FOREIGN PATENT DOCUMENTS 652322 8/1997 (EP) .

* cited by examiner

*Primary Examiner*—Anthony Knight
*Assistant Examiner*—Alison K. Pickard
(74) *Attorney, Agent, or Firm*—Greenblum & Bernstein, P.L.C.

(57) ABSTRACT

Sealing device for laterally sealing of at least one overpressure zone and vacuum zone in a paper machine and process for sealing a moving surface with the sealing device. The sealing device includes a moving surface adjacent to the at least one overpressure zone and vacuum zone, at least one sealing element positioned opposite the moving surface, a holder in which the sealing element is mounted for movement relative to the moving surface, at least one loading element arranged to load the sealing element in a direction toward the moving surface, and at least one reset element arranged to act against the at least one loading element and to move the sealing element away from the moving surface. A sealing gap formed during operation between the sealing element and the moving surface is set by at least one of the reset element and the loading element. The process includes pressurizing the at least one loading element to press the sealing element against the moving surface, and pressurizing the at least one reset element to press the sealing element against the at least one loading element and in a direction away from the moving surface, whereby a gap is formed between the sealing element and the moving surface.

31 Claims, 1 Drawing Sheet

SEALING DEVICE AND PROCESS FOR SEALING A MOVING SURFACE WITH THE SEALING DEVICE

CROSS REFERENCE TO RELATED APPLICATIONS

The present application claims priority under 35 U.S.C. §119 of German Patent Application No. 198 11 335.2, filed on Mar. 16, 1998, the disclosure of which is expressly incorporated by reference herein in its entirety.

BACKGROUND OF THE INVENTION

1. Field of the Invention

The present invention relates to a sealing device for laterally sealing at least one overpressure and vacuum zone adjacent to a moving surface in a paper machine and a process for sealing the moving surface with the sealing device. The sealing device includes at least one sealing element positioned adjacent to the moving surface, a holder in which the sealing element is mounted movably toward and away from the moving surface, and at least one loading element adapted to load the sealing element in the direction toward the moving surface.

2. Discussion of Background Information

Sealing devices such as those generally discussed above have been utilized in forming sections, press sections, and/or dry ends of a paper machine, e.g., in suction rolls or blow rolls. Suction rolls generally include stationary internal suction boxes, which form zones with at least two pressure levels. In this manner, the sealing of the pressure zones occurs through sealing ledges, which generally extend at least substantially over the entire roller length.

To obtain the desired sealing action, it has generally been customary to press the sealing elements or sealing ledges against the relevant moving surface, e.g., the inner jacket surface of a perforated suction roll, via pressure elements. However, the friction appearing between the sealing element and relevant moving surface results in significant wear of the sealing element. To limit this wear, lubricants are generally applied to the sealing element via spray tubes, which increases costs. Moreover, during operation, those ledge-type sealing elements are also pressed by the respective vacuum against the inner jacket surface. Because of the sudden ventilation of the jacket perforations following the sealing ledge adjoining a respective vacuum zone, loud noise is also generated.

U.S. Pat. No. 5,580,424 discloses a sealing ledge type sealing device of the type discussed above in which the sealing ledge is radially pressed against a suction roll jacket by at least one air tube. After the sealing ledge has been applied against the suction roll jacket, the resultant ledge position is fixed by laterally pressing the sealing ledge against a bearing block, whereupon the radial contact force is reduced to zero. However, the design of this device also includes the disadvantage that, due to the frictional fixing, a respectively desired positioning of the sealing ledge cannot be maintained with the necessary accuracy. Instead, there is a danger that the positioning of the sealing ledge may change due to vibrations resulting in a gap of undefined width consequently developing between the sealing ledge and the vacuum roll jacket. This gap formation could lead to relatively high air leakage between the pressure chambers.

SUMMARY OF THE INVENTION

The present invention provides a sealing device of the type generally discussed above in which wear of the sealing element is reduced to a minimum and an accurately defined sealing gap may be set between the sealing element and the moving surface. Moreover, the relatively high noise level of the prior art device is substantially reduced.

The present invention includes at least one reset element adapted to move the sealing element in a direction away from the moving surface, thereby acting against the loading of the sealing element by the loading element. In this manner, a sealing gap is formed between the sealing element and the moving surface may be preset by actuation of at least one of the reset element and the loading element.

Based on the arrangement of the present invention, a defined sealing gap can be set and maintained during operation such that the desired sealing action may be achieved without pressing the sealing element against the relevant moving surface, thus, reducing wear of the sealing element to a minimum. Upon start-up of the paper machine, the sealing element may be pressed against the moving surface. During subsequent normal operation, the pressing of the sealing element against the moving surface may then be relieved by the reset element so that the sealing element is substantially no longer subject to any wear. Thus, lubricants are no longer necessary and the spray tubes required in the prior art may be eliminated. Further, the noise level is clearly reduced.

In an exemplary embodiment of the present invention, the loading element and the reset element may be formed by pressure tubes. For example, the loading element may be formed by a water tube and the reset element may be formed by an air tube.

At least one of the loading and reset elements may be acted on by an adjustable pressure. Further, it may be advantageous for the loading element and a reset element to be acted upon by the adjustable pressure independently of each other.

It may be preferable, e.g., at the time of start-up of the paper machine, to apply pressure to the loading element and to remove pressure, at least substantially, from the reset element so that the sealing element may be pressed by the loading element against the moving surface. In contrast, during the subsequent normal operation, pressure is applied to both the loading element and the reset element.

In accordance with the present invention, the sealing gap produced between the sealing element and the moving surface during operation may be set by an appropriate action on the loading element and/or the reset element.

A water volume of the loading element, which may be formed, e.g., by a water tube, may be held during operation to a preferably adjustable value.

According to the exemplary embodiment, the loading element and the reset element may be arranged one above the other in the movement direction of the sealing element. The loading element may be positioned between an end of the sealing element facing away from the moving surface and a stop affixed to the holder and the reset element may be positioned between the stop affixed to the holder and a stop connected to the sealing element. Thus, the loading element and the reset element may thus be supported on one common stop affixed to the holder.

In another exemplary embodiment of the present invention, at least two loading elements may be positioned adjacent each other in a travel direction of the moving surface. In addition, or alternatively, at least two reset elements may be positioned adjacent each other in the travel direction of the moving surface. Further, it may be preferable to provide the loading and reset elements in pairs, such that each loading element is respectively associated with a reset element.

The adjacently positioned loading elements and/or the adjacently positioned reset elements may be acted upon differently such that the sealing element may assume a skewed position relative to the moving surface during operation. In this manner, a gap may be formed between the sealing element and the moving surface that widens in the travel direction, which ventilates openings provided in the moving surface in a ventilation zone that follows a sealed zone. Thus, noise occurring, e.g., in the region of a transition between a vacuum zone and overpressure zone can be further reduced.

If the adjacently positioned loading elements are formed by water tubes, it may be preferable to provide water volumes to the loading elements that are differently adjustable. Further, the sealing element may be mounted in the holder so that, at least to a limited extent, the sealing element is pivotable.

In an alternative embodiment, the sealing element may be displaceable at least substantially linearly toward and away from the moving surface, i.e., the sealing element may be substantially non-pivotable mounted, and a surface of the sealing element arranged to face the moving surface may have a course or profile that differs from that of the moving surface so that a widening gap may be formed in the travel direction.

With such a widening gap in the travel direction of the moving surface, choked ventilation of a vacuum zone may be provided, whereby the respective noise level is reduced to a minimum.

In practice, the sealing element may be formed, e.g., by a sealing ledge. Such a sealing ledge may, e.g., be arranged to extend crosswise to the travel direction of the moving surface.

The sealing device may be provided, e.g., for laterally sealing at least one pressure zone adjacent to a rotating jacket of a suction roll, a blow roll, or a moving belt, e.g., a delivery tape, a press belt, or the like, in which a vacuum zone or an overpressure zone are provided. The sealing device may be positioned between pressure zones having different pressure levels. For example, one pressure zone may be at atmospheric pressure.

If the sealing device of the present invention is provided for laterally defining at least one pressure zone adjacent to a rotating jacket of a suction roll or a blow roll, the sealing element may be preferably formed by a sealing ledge extending along at least substantially a full length of the roll.

The sealing device may be provided for laterally sealing at least one internal pressure zone adjacent to an inside wall of a rotating jacket of a suction roll or a blow roll.

The sealing device of the present invention may also be utilized for laterally sealing at least one external pressure zone adjacent an outside wall of a rotating jacket of a suction roll or blow roll.

Further, the sealing device may be provided for use between either a suction box or a blow box and either a rotating jacket of a suction roll or a blow roll, or a moving belt.

Accordingly, the present invention is directed to a sealing device for laterally sealing of at least one overpressure zone and a vacuum zone in a paper machine. The sealing device includes a moving surface adjacent to the at least one overpressure zone and vacuum zone, at least one sealing element positioned opposite the moving surface, a holder in which the sealing element is mounted for movement relative to the moving surface, at least one loading element arranged to load the sealing element in a direction toward the moving surface, and at least one reset element arranged to act against the at least one loading element and to move the sealing element away from the moving surface. A sealing gap formed during operation between the sealing element and the moving surface is set by at least one of the reset element and the loading element.

The present invention is also directed to a process of laterally sealing at least one overpressure zone and a vacuum zone adjacent a moving surface with a sealing device including at least one sealing element positioned opposite the moving surface, a holder in which the sealing element is mounted for movement relative to the moving surface, at least one loading element arranged to load the sealing element in a direction toward the moving surface, and at least one reset element arranged to act against the at least one loading element and to move the sealing element away from the moving surface. The process includes pressurizing the at least one loading element to press the sealing element against the moving surface, and pressurizing the at least one reset element to press the sealing element against the at least one loading element and in a direction away from the moving surface, whereby a gap is formed between the sealing element and the moving surface.

In accordance with another feature of the present invention, when the at least one loading device is initially pressurized, the at least one reset element is substantially unpressurized.

In accordance with another feature of the present invention, when the at least one reset element is initially pressurized, the at least one loading element remains pressurized.

In accordance with another feature of the present invention, the at least one loading element includes at least two loading elements positioned adjacent to each other in a travel direction of the moving surface, and the at least one reset element includes at least two reset elements positioned adjacent each other in the travel direction, and process further includes pressurizing the at least two loading elements with different pressures, whereby a widening gap between the sealing element and the moving surface in the travel direction is formed.

In accordance with another feature of the present invention, the at least one loading element includes at least two loading elements positioned adjacent to each other in a travel direction of the moving surface, and the at least one reset element includes at least two reset elements positioned adjacent each other in the travel direction, and process further includes pressurizing the at least two reset elements with different pressures, whereby a widening gap between the sealing element and the moving surface in the travel direction is formed.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
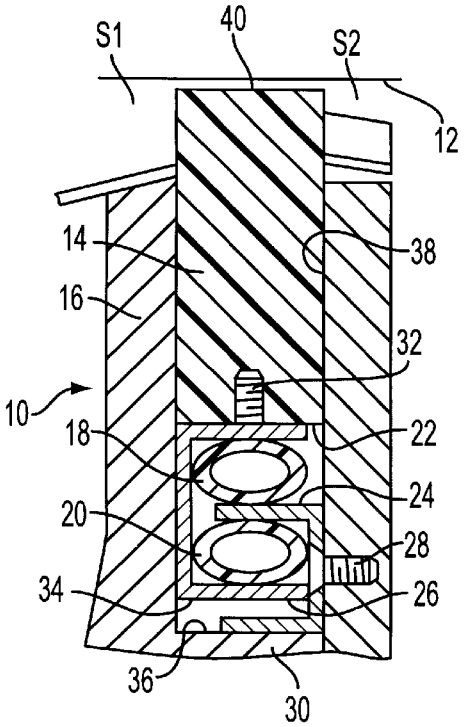
FIG. 1 schematically illustrates a first embodiment of a sealing device of the present invention that includes a loading element and reset element.

FIG. 1 schematically illustrates a first embodiment of the sealing device 10, which can be used, e.g., for laterally sealing at least one overpressure zone or vacuum zone adjacent to a moving surface 12. Moving surface 12 may be, e.g., an inside wall of a suction roll, and sealing device 10 may be positioned between a suction or vacuum zone S1 and an overpressure zone S2 exposed, e.g., to the atmosphere.

Sealing device 10 includes a sealing element 14 located opposite moving surface 12, a holder 16 in which sealing element 14 is mounted movably toward and away from moving surface 12, and a loading element 18 formed by a pressure tube, e.g., a water tube, through which sealing element 14 may be loaded toward moving surface 12.

In addition to loading element 18, a reset element 20 is formed by a pressure tube, which serves to relieve sealing element 14. In the exemplary embodiment, reset element 20 may be an air tube arranged such that, upon actuation, it acts on sealing element 14 in a direction against the loading by loading element 18, i.e., away from moving surface 12.

In the exemplary embodiment of FIG. 1, loading element 18 and reset element 20 may be arranged one above the other in the direction of movement of sealing element 14, e.g., substantially at a right angle to moving surface 12.

Loading element 18 may be positioned between an end 22 of sealing element 14 which faces away from moving surface 12 and a stop 24 affixed to holder 16, and reset element 20 may be positioned between stop 24, which is affixed to holder 16 and a stop 26 coupled to sealing element 14.

As illustrated in FIG. 1, stop 24 that may be affixed to holder 16 can be formed by an upper leg of a U-section 30 attached, e.g., screws 28, to holder 16. Stop 26 may be formed by a bottom leg of a U-section 34 attached, e.g., by screws 32, to end 22 of sealing element 14. The two U-sections 30 and 34 may also be arranged so that one of the legs of each U-section is positioned within the other U-section. In this way, U-sections 30 and 34 may be arranged between lower end 22 of sealing element 14 and base 36 of a receptacle 38 formed in holder 16, and sealing element 14 may be inserted within holder 16 for movement relative to moving surface 12.

Upon start-up of the paper machine, loading element 18, which may be formed by a water tube, may be pressurized, while reset element 20, which may be formed by an air tube, may be initially substantially unpressurized. Thus, sealing element 14 may be initially pressed against moving surface 12 by loading element 18.

For the following normal operation, reset element 20 serves to relieve sealing element 14 by being pressurized. The supply of water to the water tube forming loading element 18 may be shut off. Consequently, sealing element 14 may be pressed by reset element 20 against the water tube of loading element 18, which may have a constant water volume, in a direction away from moving surface 12. In this manner, a defined sealing gap 40 may be set between sealing element 14 and moving surface 12. Alternatively, the water volume may be adjustable.

Figure 2:
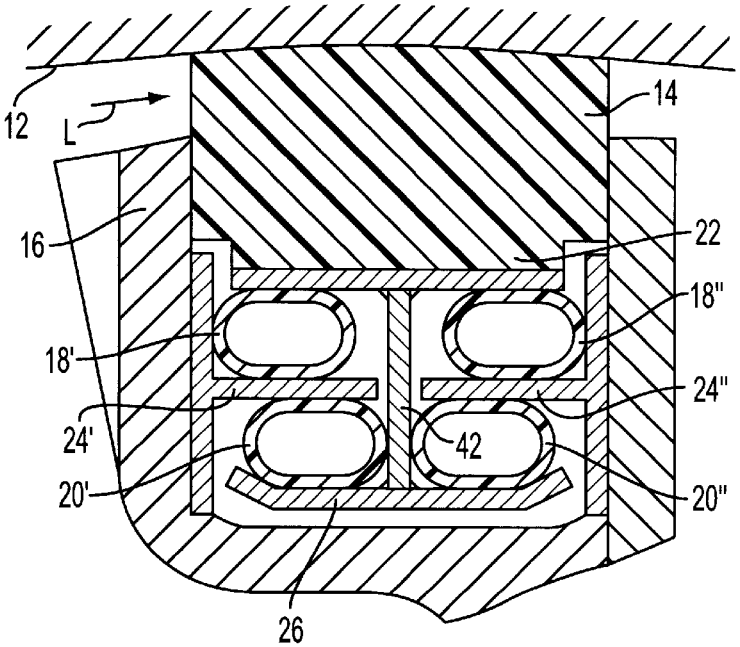
FIG. 2 schematically illustrates an alternative embodiment of the sealing device of the present invention which includes two loading elements and two reset elements.

In an alternative embodiment depicted in FIG. 2, two loading elements 18' and 18' may be positioned adjacent to each other in a direction of travel L of moving surface 12 and to reset elements 20' and 20", respectively, which may be arranged adjacent each other in the direction of travel L. Loading elements 18' and 18" and reset elements 20' and 20" may be arranged in pairs so that a reset element 20' or 20" may be located, e.g., offset below each loading element 18', 18". As illustrated in FIG. 2, the distance between the two upper loading elements 18', 18" may be somewhat greater than a distance between the two lower reset elements 20', 20".

The two loading elements 18', 18" may be formed by water tubes and the two reset elements 20', 20" may be formed by air tubes.

Loading elements 18', 18" and reset elements 20', 20" of a respective pair of elements may be supported on a common stop 24' or 24" affixed to holder 16. The lower reset elements 20', 20" may be located between respective stop 24' or 24" affixed to holder 16 and a common stop 25, which is solidly connected by a web 42 to lower end 22 of sealing element 14. Common stop 26 is bent slightly upwardly on each of its two ends, so that, not only are reset elements 20' and 20" appropriately positioned, but a tilting moment may be generated.

In other respects, this embodiment has at least substantially the same design as that of FIG. 1. Thus, parts which correspond to those depicted in FIG. 1 are provided with the same reference characters. Also, substantially the same functional mode results as in the embodiment according to FIG. 1.

Figure 3:
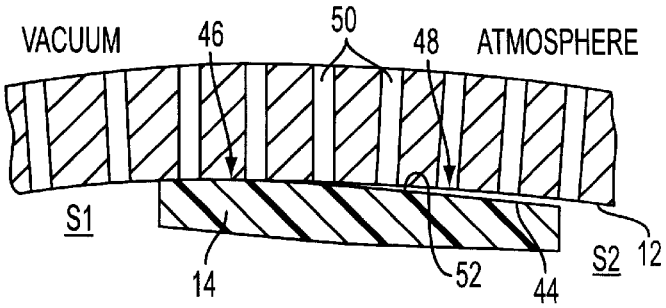
FIG. 3 schematically illustrates a partial view of another embodiment of the sealing device of the present invention in which a widening gap is formed.

In addition, sealing element 14 may be designed and/or acted on such that a gap 44, formed between moving surface 12 and sealing element 14, may widen in travel direction L during operation, as illustrated in FIG. 3. In this way, ventilation from openings 50 may be provided in moving surface 12 in a ventilation zone 48 following a sealed zone 46. In the illustrated embodiment, moving surface 12 may be formed, e.g., by a jacket of a suction roller.

With gap 44 widening in travel direction L, a choked ventilation of vacuum zone S1 may be achieved, in which the noise normally generated in the transition region between vacuum zone S1 and overpressure zone S2 connected to the atmosphere may be significantly reduced.

Gap 44 widening in travel direction L depicted in FIG. 3 may, e.g., be generated by different volumes of water in the respective loading elements 18' and 18".

In principle, gap 44 opening in the form of a wedge to overpressure zone S2 may be generated, e.g., in that surface 52 of ledge type sealing element 14 facing moving surface 12 may have a course or profile which differs from that of moving surface 12. Thus, surface 52 may, e.g., be curved corresponding to the sector of a circle whose midpoint is offset relative to an axis of the roll.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

List of Reference Characters

10 sealing device
12 moving surface
14 sealing element
16 holder
18 loading element
18' loading element
18" loading element
20 reset element
20' reset element
20" reset element
22 end
24 stop affixed to the holder
24' stop affixed to the holder
24" stop affixed to the holder
26 stop
28 screws
30 U-section
32 screws
34 U-section
36 base
38 receptacle
40 sealing gap
42 web
44 widening gap
46 sealing zone
48 ventilation zone
50 openings
52 surface
L direction of travel
S1 suction or vacuum zone
S2 overpressure zone

What is claimed:

1. A sealing device for laterally sealing of at least one overpressure zone and vacuum zone in a paper machine, comprising:

a moving surface adjacent to the at least one overpressure zone and vacuum zone;

at least one sealing device positioned opposite the moving surface;

a holder in which the at least one sealing element is mounted for movement relative to the moving surface;

at least one loading element arranged to force the at least one sealing element in a direction toward the moving surface; and at least one reset element independently pressurized to apply a force solely in an opposite direction of the force applied by the at least one loading element for moving the sealing element away from the moving surface, wherein a sealing gap formed during operation between the at least one sealing element and the moving surface can be set by at least one of the at least one reset element and the at least one loading element.

2. The sealing device according to claim 1, the at least one loading element and the at least one reset element are composed of pressure tubes.

3. The sealing device according to claim 2, the loading element is composed of a water tube and the reset element is composed of an air tube.

4. The sealing device according to claim 2, the loading element is pressurizable with an adjustable pressure.

5. The sealing device according to claim 1, the reset element is pressurizable with adjustable pressure.

6. The sealing device according to claim 1, the loading element and the reset element are actuatable independently of each other.

7. The sealing device according to claim 1, the sealing gap is adjustable by adjusting at least one of the at least one loading element and the at least one reset element.

8. The sealing device according to claim 1, the at least one loading element being composed of a water tube having a water volume that, during operation, is kept at an adjustable value.

9. The sealing device according to claim 1, the at least one loading element and the at least one reset element are arranged one above the other in a direction of motion of the sealing element.

10. The sealing device according to claim 1, the sealing element is composed of a sealing ledge.

11. The sealing device according to claim 10, the sealing ledge is arranged to extend crosswise to a travel direction of the moving surface.

12. The sealing device according to claim 1, the moving surface being composed of one of a rotating jacket of one of a suction roll and a blow and a moving belt.

13. The sealing device according to claim 12, the moving surface being composed of the rotating jacket of one of a suction roll and a blow roll; and the sealing element being composed of a sealing ledge extending at least substantially over an entire roll length.

14. The sealing device according to claim 13, adapted for laterally sealing at least one internal pressure zone adjacent an inside wall of the rotating jacket.

15. The sealing device according to claim 13, adapted for laterally sealing at least one outer pressure zone adjacent an outside wall of the rotating jacket.

16. The sealing device according to claim 1, adapted for use between (1) one of a suction and blow box, and (2) either a rotating jacket of one of a suction roller and blow roll or a moving belt.

17. A sealing device for laterally sealing of at least on overpressure zone and vacuum zone in a paper machine, comprising:

a moving surface adjacent to the at least one overpressure zone and vacuum zone;

at least one sealing element positioned opposite the moving surface;

a holder in which the at least one sealing element is mounted for movement relative to the moving surface;

at least one loading element arranged to force the at least one sealing element in a direction toward the moving surface; and at least one reset element independently pressurized to apply a force against the force applied by the at least one loading element for moving the sealing element away from the moving surface, wherein a sealing gap formed during operation between the at least one sealing element and the moving surface can be set by at least one of the at least one reset element and the at least one loading element;

the at least one loading element comprising at least two loading elements disposed adjacent to each other in a travel direction of the moving surface.

18. The sealing device according to claim 17, the at least one reset element comprising at least two reset elements disposed adjacent each other in the travel direction.

19. The sealing device according to claim 18, the at least two loading elements and the at least two reset elements are arranged in pairs, in which one reset element is associated with each loading element.

20. The sealing device according to claim 17, the sealing element is one of structured and acted upon to form a widening gap with the moving surface in a travel direction of the moving surface, whereby ventilation openings in the moving surface are opened to a ventilation zone following a sealing zone.

21. The sealing device according to claim 20, wherein at least one of adjacently disposed at least two loading elements and adjacently disposed reset elements may be pressurized differently to arrange the sealing element in a skewed position, whereby the widening gap is formed with the moving surface in the travel direction of travel.

22. The sealing device according to claim 21, the adjacently disposed at least two loading elements being composed of water tubes, and water volumes of the at least two loading elements are adjusted differently.

23. The sealing device according to claim 20, a surface of the sealing element facing the moving surface has a course that differs from that of the moving surface, whereby the widening gap is formed with the moving surface in the travel direction.

24. A sealing device for laterally sealing of at least one overpressure zone and vacuum zone in a paper machine, comprising:

a moving surface adjacent to the at least one overpressure zone and vacuum zone;

at least one sealing element positioned opposite the moving surface;

a holder in which the at least one sealing element is mounted for movement relative to the moving surface;

at least one loading element arranged to load the sealing element in a direction toward the moving surface;

at least one reset element arranged to act against the at least one loading element and to move the at least one sealing element away from the moving surface;

a first stop affixed to the holder; and a second stop coupled to the at least one sealing element;

wherein a sealing gap formed during operation between the sealing element and the moving surface can be set by at least one of the least one reset element and the at least one loading element;

wherein the at least one loading element and the at least one reset element are arranged one above the other in a direction of motion of the at least one sealing element;

wherein the at least one loading element is positioned between an end of the at least one sealing element that faces away from the moving surface and the first stop;

wherein the at least one reset element is positioned between the first stop and the second stop.

25. A process of laterally sealing at least one overpressure zone and a vacuum zone adjacent a moving surface with a sealing device including at least one sealing element positioned opposite the moving surface, a holder in which the sealing element is mounted for movement relative to the moving surface, at least one loading element arranged to force the sealing element in a direction toward the moving surface, and at least one reset element arranged to apply a force solely in an opposite direction of the force applied by the at least one loading element and to move the sealing element away from the moving surface, the process comprising:

pressurizing the at least one loading element to force the sealing element against the moving surface; and separately pressurizing the at least one reset element to apply a force against the force applied by the at least one loading element and in a direction away from the moving surface, whereby a gap is formed between the sealing element and the moving surface.

26. The process according to claim 25, wherein, when the at least one loading device is initially pressurized, the at least one reset element is substantially unpressurized.

27. The process according to claim 25, wherein, when the at least one reset element is initially pressurized, the at least one loading element remains pressurized.

28. A process of laterally sealing at least one overpressure zone and a vacuum zone adjacent a moving surface with a sealing device including at least one sealing element positioned opposite the moving surface, a holder in which the sealing element is mounted for movement relative to the moving surface, at least one loading element arranged to force the sealing element in a direction toward the moving surface, and at least one reset element arranged to apply a force against the force applied by the at least one loading element and to move the sealing element away from the moving surface, the process comprising:

pressurizing the at least one loading element to force the sealing element against the moving surface; and separately pressurizing the at least one reset element to apply a force against the force applied by the at least one loading element and in a direction away from the moving surface, whereby a gap is formed between the sealing element and the moving surface;

wherein the at least one loading element includes at least two loading elements positioned adjacent to each other in a travel direction of the moving surface, and the at least one reset element includes at least two reset elements positioned adjacent each other in the travel direction, and said process further comprises;

pressurizing the at least two loading elements with different pressures, whereby a widening gap between the sealing element and the moving surface in the travel direction is formed.

29. A process of laterally sealing at least one overpressure zone and a vacuum zone adjacent a moving surface with a sealing device including at least one sealing element positioned opposite the moving surface, a holder in which the sealing element is mounted for movement relative to the moving surface, at least one loading element arranged to force the sealing element in a direction toward the moving surface, and at least one reset element arranged to apply a force against the force applied by the at least one loading element and to move the sealing element away from the moving surface, the process comprising:

pressurizing the at least one loading element to force the sealing element against the moving surface; and separately pressurizing the at least one reset element of apply a force against the force applied by the at least one loading element and in a direction away from the moving surface, whereby a gap is formed between the sealing element and the moving surface;

wherein the at least one loading element includes at least two loading elements positioned adjacent to each other in a travel direction of the moving surface, and the at least one reset element includes at least two reset elements positioned adjacent each other in the travel direction, and said process further comprises:

pressurizing the at least two reset elements with different pressures, whereby a widening gap between the sealing element and the moving surface in the travel direction is formed.

30. A sealing device for laterally sealing at least one overpressure zone and vacuum zone in a paper machine, comprising:

a moving surface adjacent to the at least one overpressure zone and vacuum zone;

at least one sealing element positioned opposite said moving surface;

a holder in which said at least one sealing element is mounted for movement relative to said moving surface;

at least one loading pressure tube arranged to force said at least one sealing element in a direction toward said moving surface; and at least one reset pressure tube independently pressurized to apply a force solely in an opposite direction to the force applied by said at least one loading pressure tube and to move said sealing element away from said moving surface;

wherein a sealing gap formed during operation between said sealing element and said moving surface can be set by at least one of said at least one reset pressure tube and said at least one loading pressure tube.

31. A process of laterally sealing at least one overpressure zone and a vacuum zone adjacent a moving surface with a sealing device including at least one sealing element positioned opposite the moving surface, a holder in which the sealing element is mounted for movement relative to the moving surface, at least one loading element arranged to force the sealing element in a direction toward the moving surface, and at least one reset element arranged to apply a force solely in an opposite direction to the force applied by the at least one loading element and to move the sealing element away from the moving surface, the process comprising:

pressurizing the at least one loading tube to force the sealing element against the moving surface; and separately pressurizing the at least one reset tube to apply a force solely in an opposite direction of the force applied by the at least one loading element and in a direction away from the moving surface, whereby a gap is formed between the sealing element and the moving surface.

* * * * *